US009586127B2

(12) United States Patent
Avgustin

(10) Patent No.: US 9,586,127 B2
(45) Date of Patent: Mar. 7, 2017

(54) COLLAPSIBLE SKI

(71) Applicant: ELAN, D.O.O., Begunje na Gorenjskem (SI)

(72) Inventor: Vinko Avgustin, Zirovnica (SI)

(73) Assignee: ELAN, D.O.O., Begunje Na Gorenjskem (SI)

( * ) Notice: Subject to any disclaimer, the term of this patent is extended or adjusted under 35 U.S.C. 154(b) by 0 days.

(21) Appl. No.: 14/892,904

(22) PCT Filed: Apr. 30, 2014

(86) PCT No.: PCT/SI2014/000022
§ 371 (c)(1),
(2) Date: Nov. 20, 2015

(87) PCT Pub. No.: WO2014/189472
PCT Pub. Date: Nov. 27, 2014

(65) Prior Publication Data

US 2016/0107068 A1 Apr. 21, 2016

(30) Foreign Application Priority Data

May 22, 2013 (SI) ..... 201300124

(51) Int. Cl.
*A63C 5/02* (2006.01)
*A63C 9/00* (2012.01)

(52) U.S. Cl.
CPC ..... *A63C 5/02* (2013.01); *A63C 9/003* (2013.01); *A63C 2203/10* (2013.01)

(58) Field of Classification Search
CPC ..... A63C 5/02; A63C 5/031; A63C 9/003; A63C 2203/10; A63C 2203/06
USPC ..... 280/603
See application file for complete search history.

(56) References Cited

U.S. PATENT DOCUMENTS 2,433,596 A * 12/1947 Carrier ..... A63C 5/02 280/603
3,797,844 A * 3/1974 Smolka ..... A63C 9/007 280/607
3,801,117 A * 4/1974 Pierce ..... A63C 5/02 280/603

(Continued)

FOREIGN PATENT DOCUMENTS

GB 2501742 11/2013

*Primary Examiner* — Frank Vanaman
(74) *Attorney, Agent, or Firm* — Haynes and Boone, LLP; William B. Nash; Joseph R. Mencher

(57) ABSTRACT

A collapsible ski includes a front part and a rear part that, when arranged in their linearly aligned position, are fixed in that position by a connecting platform which is rotatable around an axis, which extends throughout a fold between the front part and rear part, and which is rectangular. Benefits of such a collapsible ski may include, to a consumer, practical storage and transporting benefits, while to the manufacturer, may include simplification of technology for manufacturing of each component, when compared with manufacturing of classic single-part skis. The collapsible ski can be assembled in place simply without using any tools. The collapsible ski is assembled of several mutually connectable yet detachable parts. The collapsible ski also provides the possibility of combining separately manufactured and preferably standardized parts in view of providing semi-products and finalizing each collapsible ski.

14 Claims, 7 Drawing Sheets

(56) References Cited

U.S. PATENT DOCUMENTS

| | | | | | |
|---|---|---|---|---|---|
| 4,125,273 | A * | 11/1978 | Rothmayer | A63C 5/02 | 16/264 |
| 4,405,150 | A | 9/1983 | Esper | | |
| 4,645,228 | A * | 2/1987 | Bertonneau | A63C 5/02 | 280/603 |
| 5,020,821 | A | 6/1991 | Leroy | | |
| 2012/0306171 | A1 * | 12/2012 | Shirion | A63C 5/02 | 280/11.15 |
| 2013/0106068 | A1 * | 5/2013 | Franko | A63C 5/02 | 280/11.15 |

* cited by examiner

COLLAPSIBLE SKI

CROSS-REFERENCE TO RELATED APPLICATION

This application is a United States national phase application of co-pending international patent application number PCT/SI2014/000022 filed Apr. 30, 2014, which claims the benefit of Slovenia Application No. P-201300124 filed May 22, 2013. The contents of both applications are incorporated by reference herein in their entirety.

BACKGROUND

The present disclosure is related to sports, specifically to skis, and in particular to a collapsible ski.

A collapsible ski is disclosed in U.S. Pat. No. 4,405,150. Such a ski, in its functionally assembled state, and when ready for use, like any other ski, comprises a front area with a tip, which is bent away from the ground, a rear area with a so-called tail, which is either planar or slightly bent away from the ground, as well as a central region, which is located between the front area and the rear area and is adapted for mounting each desired ski binding. A surface, which is during use is faced towards the ground, is furnished with a sliding layer, and both longitudinal edges thereof are appropriately reinforced in order to enable guidance of the skis by turning along a hard ground. Such a ski essentially consists of at least three parts, which are connectable to each other in a detachable manner: a front part and a rear part, which are pivotally connected with each other in the central region of the ski, as well as a covering part or top plate, which is pivotally connected with the rear part and can be placed over at least a portion of the front part and rear part of the ski and which is also fixed in such position when covering the front part and rear part. The covering part is designed as a U-profile and is adapted to engage with two ribs, which are present on the surface of the front part and the rear part at least in the central region of the ski, specifically, in the area of engagement with the covering part. Those skilled in the art will understand that, by bending such a ski due to bending deformation, the covering part and in particular a free end portion thereof is exposed to forces which can cause removal of the covering part from the surface of the ski. Thus, the covering part must be firmly fixed onto the surface of the ski, wherein the location of its attachment is exposed to high stresses.

A collapsible ski is also disclosed in U.S. Pat. No. 5,020,821. Such a concept actually enables relative movements of the covering part relative to the front part and rear part, which are pivotally connected with each other. The front part and rear part are, in the area of cooperation or engagement with the covering part, essentially thickened, by which the rigidity thereof is essentially increased. Such local increasing of rigidity changes bending characteristics of the ski as a whole, since its deflecting capability in the front portion and the rear portion is essentially higher than in the central region.

In addition, due to such a concept, the so-called standing height is also essentially changed or increased. Specifically, a distance between the sliding surface and the bottom surface of a ski boot is changed. Such a distance might be beneficial for skilled users, e.g. in ski competitions, but is in contradiction with the concept of the ski as such, since it appears to be totally inappropriate for such purposes.

Moreover, the concept of such a U-shaped covering part does not enable mounting of rails suitable for quickly mounting ski bindings. Modifying the covering part to such purposes would lead to still further increasing of the standing height and also of the weight and rigidity of the ski.

Thus, what is needed is a collapsible ski which addresses the above issues.

SUMMARY

Embodiments of the present disclosure provide a collapsible ski, comprising in its assembled, or functional, state: a front portion with a tip slightly bent away from the ground; a rear portion with a tail, either essentially flat or slightly away from the ground deflected; as well as a central region, which is adapted for mounting a ski binding consisting of a front part and a rear part and being suitable for attaching each ski shoe onto the top surface of the ski. During the use of the ski, the top surface of the ski is faced away from the ground, while the opposite sliding surface is, during the use of the ski, faced towards the ground and is along nearly its complete length bounded i.e. ended with two ski edges. Such a ski is assembled and consists of a front part and a rear part, which are mutually interconnected pivotally around a transversal geometrical axis extending parallel to said sliding surface and are optionally fixed in their linearly aligned state by means of a connecting platform, which is adapted to receive said front part and said rear part of the ski binding for mounting each ski shoe onto the top surface of the ski.

The present disclosure provides a ski assembled of several detachable parts connected to one another, which can be assembled in place without any tools. Benefits of such a collapsible ski may include, on one hand, to a consumer, practical storage and transporting benefits, while on the other hand, to the manufacturer, may include simplification of technology for manufacturing of each particular component, when compared with manufacturing of classic single-part skis. The creative concept and benefit of each connectable and detachable part, and in its connected form, such should provide to each user all benefits of modern skis, including a uniform bending line, a regular distribution of loadings along the ski edges, and the possibility of quickly mounting or replacing a ski binding in place, or the like. Starting from the simplifying of the technology of manufacturing each particular part, the present disclosure provides the possibility of combining such separately manufactured and preferably standardized parts both in view of providing partially-assembled semi-products and finalizing each collapsible ski as such.

The front part and the rear part of the ski, when arranged in their linearly aligned position, are allowed to be fixed in such position by means of a platform, which is rotatable around an axis, and which extends throughout a fold between the parts and which is rectangular with respect to the sliding surface.

The front part and the rear part of the ski are connected with each other either in a non-detachable manner or in a detachable manner.

Each particular connecting platform, each having predetermined and optionally standardized dimensions, is generally due to its rotation around the transversal axis extending throughout the fold and perpendicular with respect to the sliding surface, optionally in a detachable manner connectable with each desired assembly of a mutually interconnected front part and rear part, the length of which is determined optionally and independently on dimensions of the connecting platform.

In accordance with one of possible embodiments of the present disclosure, the front part of the ski is, in the area of cooperation or engagement with the connecting platform, furnished with an indentation. The rear part of the ski, in the area of cooperation or engagement with the connecting platform, is furnished with an indentation. The connecting platform is adapted to be placed within the area of the indentations of the front part and rear part.

In one embodiment, the connecting platform is, on each of its terminal portions, which protrude apart from each other, furnished with a convex circular surface having a predetermined radius of curvature, and a protrusion is available on each of the convex surfaces. The indentation on the front part is ended with a concave circular surface, the radius of curvature of which is adjusted to the radius of curvature on each corresponding terminal portion of the connecting platform, and which is furnished with a groove, which is adapted to cooperate or engage with the protrusion on the corresponding terminal portion of the connecting platform. The indentation on the rear part is ended with a concave circular surface, the radius of curvature of which is adjusted to the radius of curvature on each corresponding terminal portion of the connecting platform, and which is furnished with a groove, which is adapted to cooperate or engage with the protrusion on the corresponding terminal portion of the connecting platform.

In accordance with a further possible embodiment of the present disclosure, the front part of the ski is furnished with a guiding protrusion which is located on the essentially flat top surface of the ski in the area of cooperation or engagement with the connecting platform. The rear part of the ski is furnished with a guiding protrusion which is located on the essentially flat top surface of the ski in the area of cooperation or engagement with the connecting platform, wherein the connecting platform is adapted to be placed in the area of the guiding protrusions.

In one embodiment, the connecting platform is, on each of its terminal portions, which protrude apart from each other, furnished with a convex circular surface having a predetermined radius of curvature, and a protrusion is available on each of the convex surfaces. The guiding protrusion on the front part is ended with a concave circular surface, the radius of curvature of which is adjusted to the radius of curvature on each corresponding terminal portion of the connecting platform, and which is furnished with a groove, which is adapted to cooperate or engage with the protrusion on the corresponding terminal portion of the connecting platform. The guiding protrusion on the rear part is ended with a concave circular surface, the radius of curvature of which is adjusted to the radius of curvature on each corresponding terminal portion of the connecting platform, and which is furnished with a groove, which is adapted to cooperate or engage with the protrusion on the corresponding terminal portion of the connecting platform.

A connecting member for establishing a pivotal interconnection between the front part and the rear part of the ski is hinge-like, conceived and furnished with arresting or prominent protrusions, which protrude apart from each other and are arranged such that the arresting or prominent protrusion on the front part of the ski is located at a distance apart from the top surface of the front part of the ski and is directed towards the tip of the ski, and the arresting or prominent protrusion on the rear part of the ski is located at a distance apart from the top surface of the rear part of the ski and is directed towards the tail of the ski. The connecting platform is furnished with a centrally arranged cavity, which is located on its bottom surface facing towards the front part and rear part of the ski and within which two diametrically opposite recesses are arranged, which are adapted to cooperate or engage with the arresting or prominent protrusions on the connecting member, such that the arresting or prominent protrusions on the connecting member are allowed to be inserted into the cavity. The arresting or prominent protrusions are allowed to be inserted into the cavity of the connecting member when the front part and the rear part of the ski are linearly aligned and the connecting platform is rotated at a certain angle around the vertical axis with respect to their longitudinal direction, and when the connecting platform is rotated around the vertical axis into a position in which it is linearly aligned with the parts of the ski, then the protrusions of the connecting member are inserted within the recesses in the cavity of the connecting platform, by which the connecting platform is firmly, but still in a detachable manner, interconnected with the front part and rear part of the ski.

In each of the previously described embodiments, the connecting platform includes suitable assemblies for mounting the front part and the rear part of the ski binding.

These and other embodiments in accordance with the present disclosure will be understood with reference to the description and appended claims which follow.

BRIEF DESCRIPTION OF THE DRAWINGS

The present disclosure is illustrated by way of example and not limitation with reference to the accompanying figures, in which like references generally indicate similar elements or features.

Skilled artisans will appreciate that elements or features in the figures are illustrated for simplicity and clarity and have not necessarily been drawn to scale. For example, the dimensions or prominence of some of the illustrated elements or features may be exaggerated relative to other elements or features in an effort to help to improve understanding of embodiments of the present disclosure.

DETAILED DESCRIPTION

Embodiments disclosed herein describe a collapsible ski according to various implementations, which are conceptually similar, but varied in their execution, manufacturing, and functionality. The various embodiments are presented in FIGS. 1-11.

Figure 1:
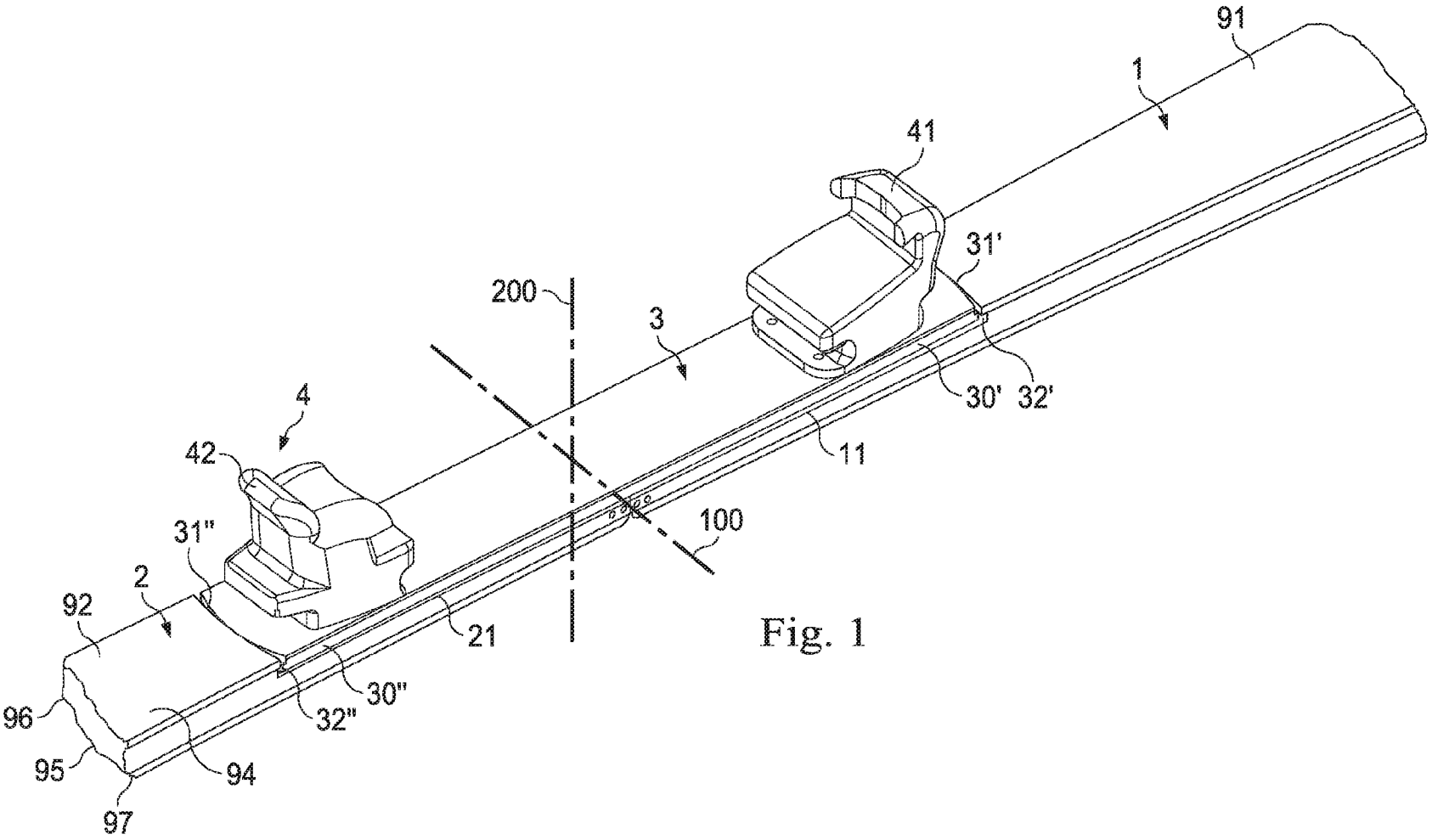
FIG. 1 is a simplified isometric view of the first embodiment of a collapsible ski in its assembled or functional state.
Figure 2:
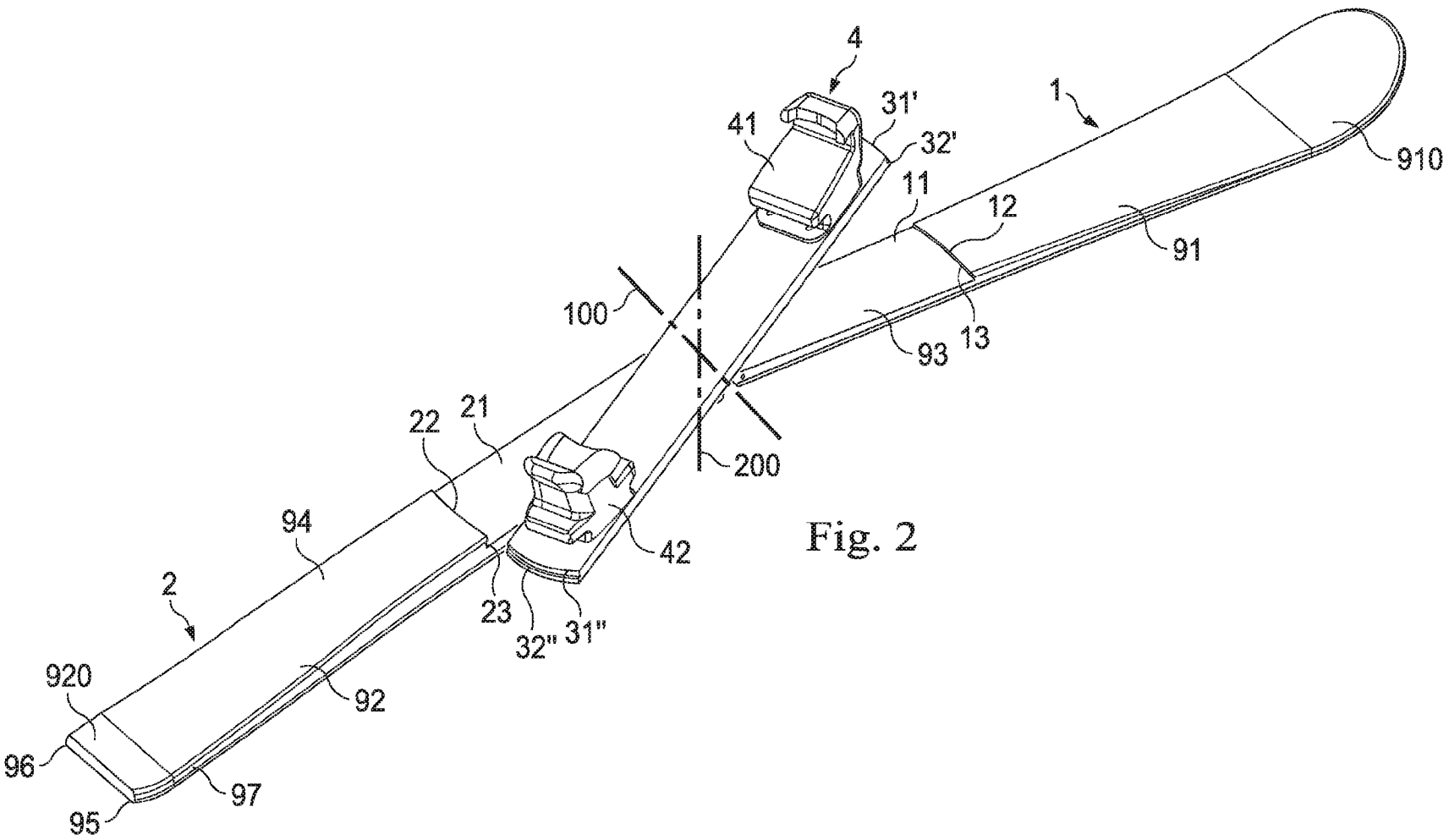
FIG. 2 is an isometric view of a ski according to FIG. 1 during assembling.

FIGS. 1-2 depict a collapsible ski in its assembled, or functional state, comprising a front part 91 with a tip 910 (depicted in FIG. 2), which is gradually bent away from the ground, a rear part 92 with a tail 920, which is either essentially flat or gradually bent away from the ground, as well as a central part 93, which is adapted for mounting of a ski binding 4, which is suitable for attaching a ski shoe (not pictured) onto the top surface 94 of the ski. A sliding surface 95 is arranged opposite to the top surface 94 and is faced towards the ground and furnished with lateral ski edges 96, 97 extending practically along the complete length of the ski.

A ski binding 4 suitable for mounting onto the top surface 94 of the ski consists of a front part 41 and a rear part 42, and a ski shoe can be inserted between them, which is then by means of parts 41 and 42 of the ski binding 4 temporarily and detachably connectable with the ski. Modern skis are furnished with parts 41 and 42, which are in an easily and simple manner detachably connectable with the ski by means of connecting assemblies 410 and 420 (depicted in FIG. 7), which are integrated within the ski during manufacturing thereof. Each of connecting assemblies 410 and 420 is adapted for interconnection with each constituent part 41 and 42 of the ski binding 4. Each position of each of parts 41 and 42 of the ski binding 4 can usually be adjusted depending on each particular size of the ski shoe.

In accordance with embodiments of the present disclosure, a collapsible ski consists of a front part 1 and a rear part 2, which are pivotally connected with each other, as well as of a connecting platform 3, by means of which front part 1 and rear part 2 are optionally fixed in their linearly aligned position.

The front part 1 and rear part 2 are interconnected in the central region 93 of the ski, namely pivotally around the transversal axis 100 extending essentially parallel to the sliding surface 95 of the ski. Parts 1 and 2 can be pivotally interconnected either on a detachable manner or in a non-detachable manner, by which the ski is either collapsed or assembled.

As a result of the pivotal interconnection of front part 1 and rear part 2, parts 1 and 2 can be pivoted between their end positions. Specifically, front part 1 and rear part 2 can be pivoted between a first end position, in which front part 1 and rear part 2 are linearly aligned and form a functional shape of the ski (FIGS. 4 and 6), and a second end position, in which front part 1 and rear part 2 are pivoted with respect to each other, i.e. folded, and are placed on each other in the area of the sliding surface 95, making the collapsible ski comfortable for transport or storage, in particular when parts 1 and 2 are interconnected in a detachable manner.

Figure 3:
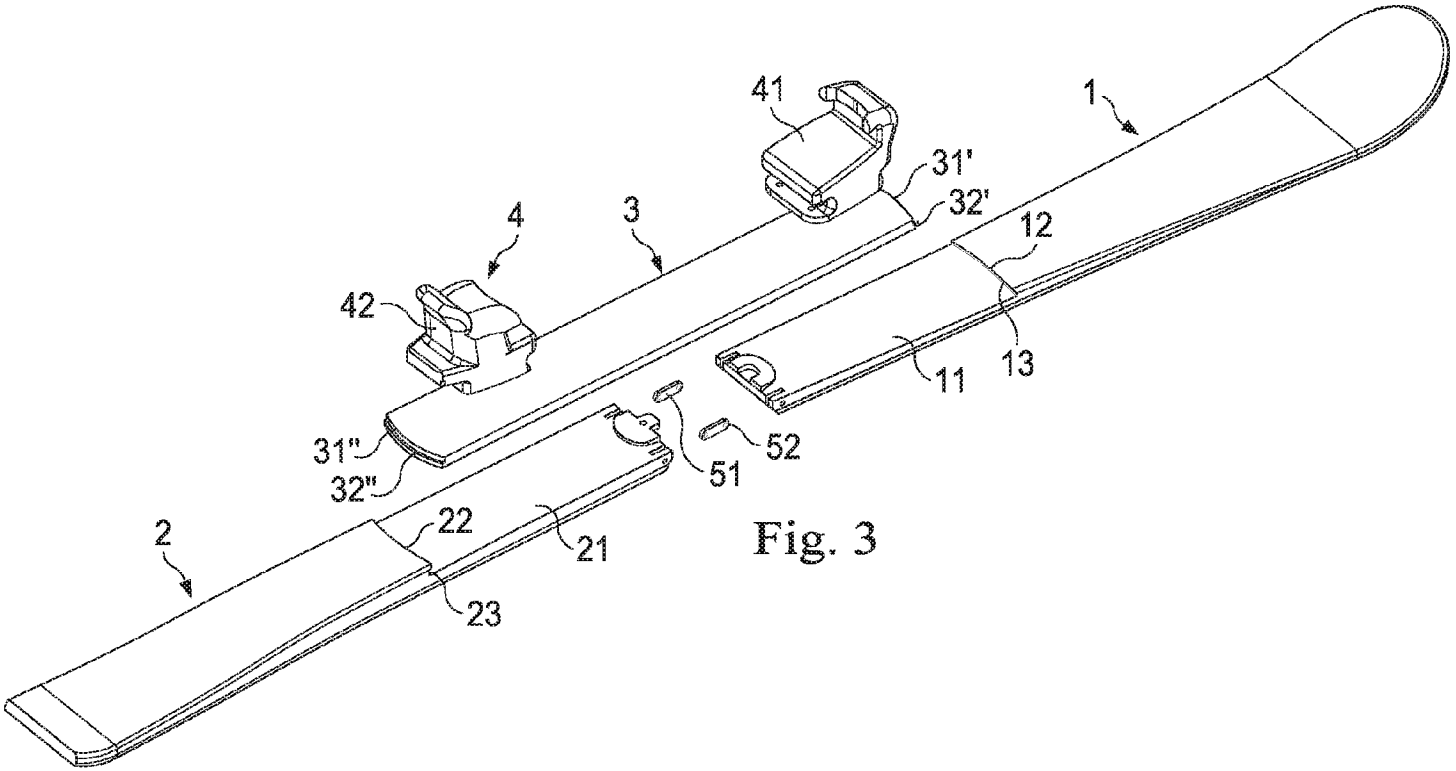
FIG. 3 is an isometric view of a ski according to FIG. 1 prior to assembling.
Figure 4:
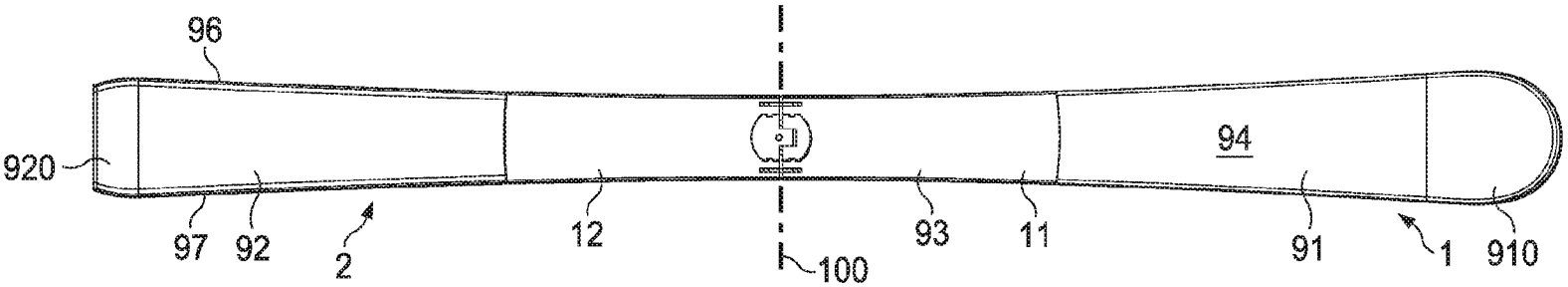
FIG. 4 is an isometric view of a ski according to FIG. 1 at the beginning of assembling, that is, prior to placement of a connecting platform.

In one embodiment as described with reference to FIG. 3, the pivotal or linked interconnection between the front part 1 and the rear part 2 is realized essentially as a hinged interconnection using connecting members 51, 52. Each connecting member 51 and 52 is by means of one or more pins or axles or other suitable elements mounted to the front part 1 and/or the rear part 2 of the ski.

Figure 9:
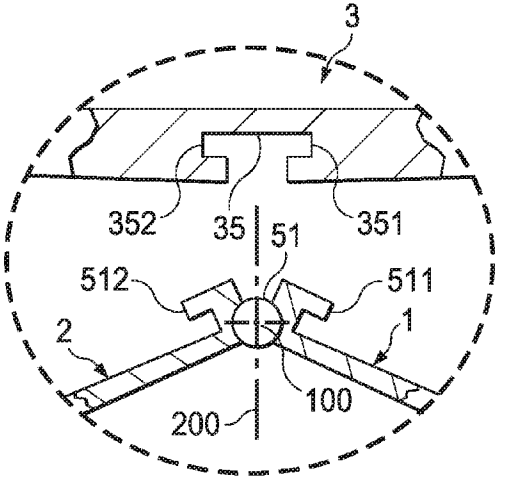
FIG. 9 is a detail view A according to FIG. 8.
Figure 10:
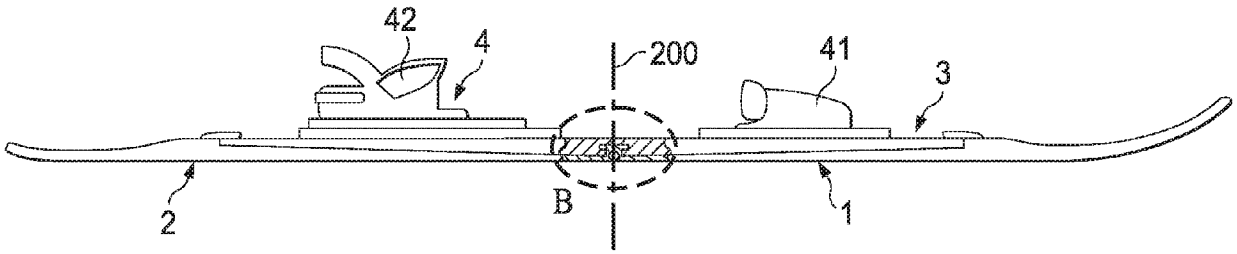
FIG. 10 is a plan view of the embodiment of a ski according to FIG. 8 in assembled state.
Figure 11:
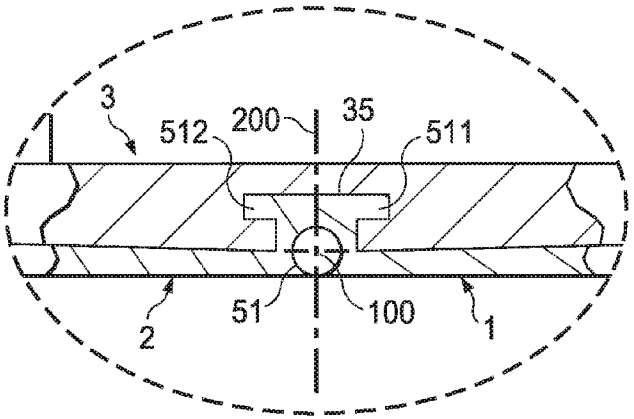
FIG. 11 is a detail view B according to FIG. 10.

In accordance with one embodiment, for example, described with reference to FIGS. 9-11, a hinge-like connecting member 51 is furnished with protrusions 511, 512, which protrude apart from each other. The protrusion 511 on the front part 1 of the ski is arranged at a distance apart from the top surface 94 of the front part 1 of the ski and is directed forwardly towards the tip 91 of the ski. The protrusion 512 on the rear part 2 of the ski is arranged at a distance apart from the top surface 94 of the rear part 2 of the ski and is directed rearward towards the tail 92 of the ski.

Moreover, the front part 1 and rear part 2 of the ski are each adapted to cooperate or engage with the connecting platform 3, which is adapted to interconnect parts 1 and 2 by rotating around a geometric axis 200 extending throughout the fold between parts 1 and 2 in the central region 93 of the ski, and at the same time perpendicularly with respect to the sliding surface 95 of parts 1 and 2, when these are aligned.

In one embodiment of the ski as shown in FIGS. 1-4, for connection of the connecting platform 3 to the front part 1 and rear part 2, the front part 1 is furnished with an indentation 11, which is located in the area of interconnection with connecting platform 3 and furnished with a concave circular front surface 12 with a pre-determined radius, in which a groove 13 is available. Similarly, the rear part 2 is also furnished with an indentation 21, which is located in the area of interconnection with connecting platform 3 and furnished with a concave circular front surface 22 with a pre-determined radius, in which a groove 23 is available.

Thus, the connecting platform 3 is adapted to cooperate or engage with parts 1 and 2, wherein its width is adjusted to the central region 93 of the ski, while its height essentially corresponds, or is adapted respectively, to the depth of cavities 11 and 21 on the front part 1 and the rear part 2 of the ski, respectively. Moreover, platform 3 is, in each terminal region 30', 30" furnished with a convex circular surface 31', 31", which is furnished with a protrusion 32', 32". Each of the protrusions 32', 32" on surfaces 31', 31" of the connecting platform 3 is adapted to cooperate or engage with a corresponding groove 13 and 23 on surfaces 12 and 22 in the area of the indentations on the front part 1 and the rear part 2 of the ski. The radius of curvature of surfaces 12 and 22 on the parts 1 and 2 is adjusted to the radius of curvature of the convex surfaces 31' and 31" on the connecting platform 3. Accordingly, connecting platform 3 can be rotated around axis 200, when placed above front part 1 and rear part 2 of the ski.

Those skilled in the art shall understand that after rotation of the platform 3 into position, in which it is aligned with the front part 1 and the rear part 2, and fixation of the platform 3 in such position by means of a suitable fixation or arresting means, such ski is an excellent substitute for a classic ski, by which an average skier should be perfectly satisfied.

Figure 5:
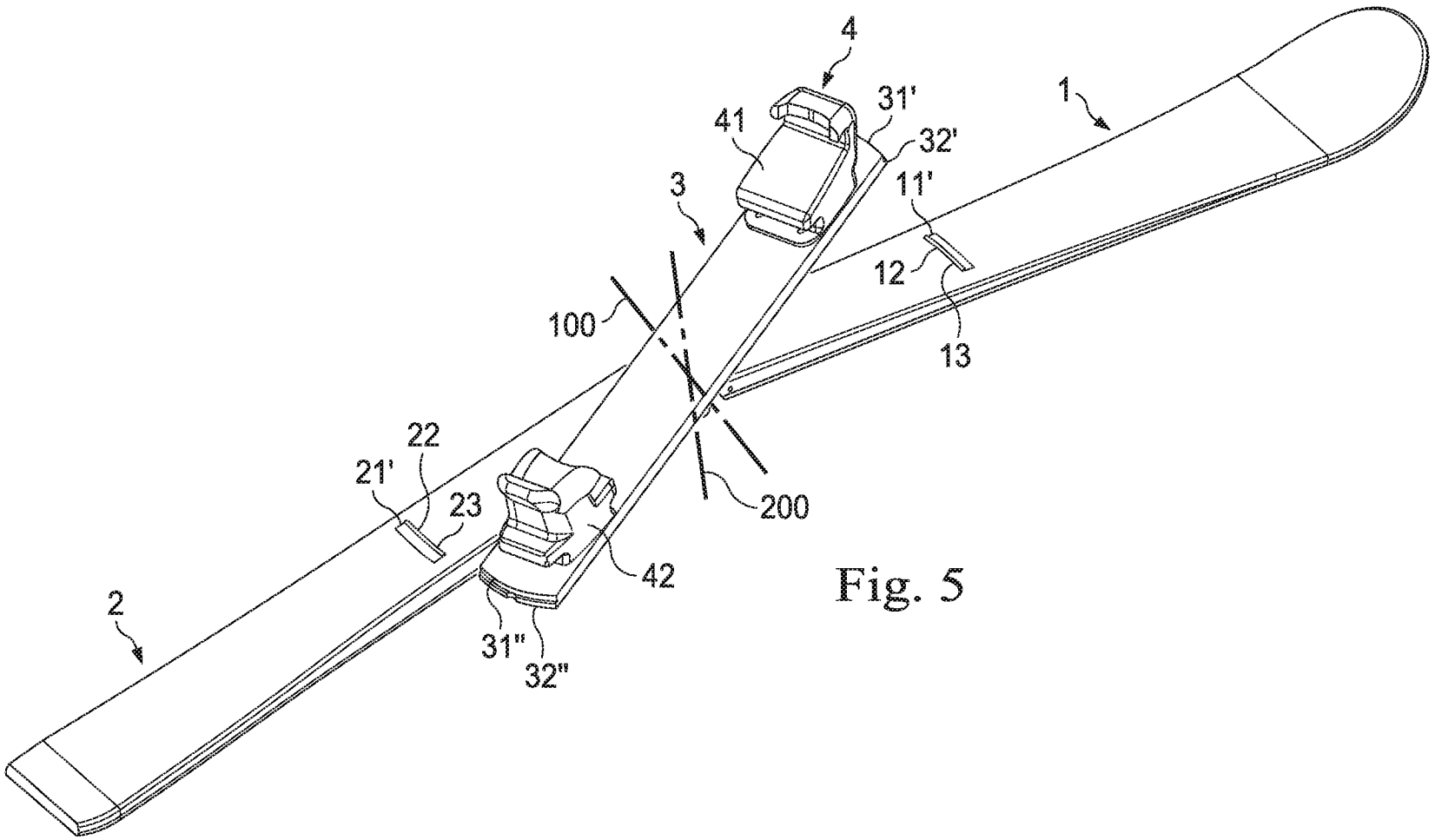
FIG. 5 is an isometric view of a further embodiment of a ski according during assembling.
Figure 6:
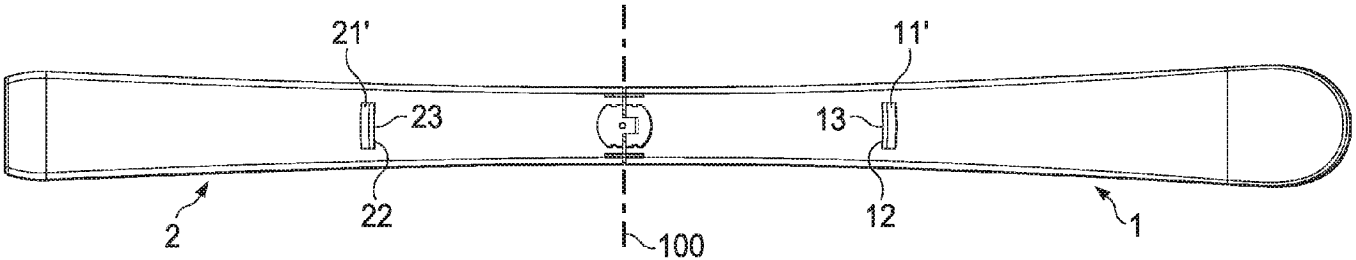
FIG. 6 is an isometric view of a ski according to FIG. 6 at the beginning of assembling i.e. prior to placement of a connecting platform.
Figure 7:
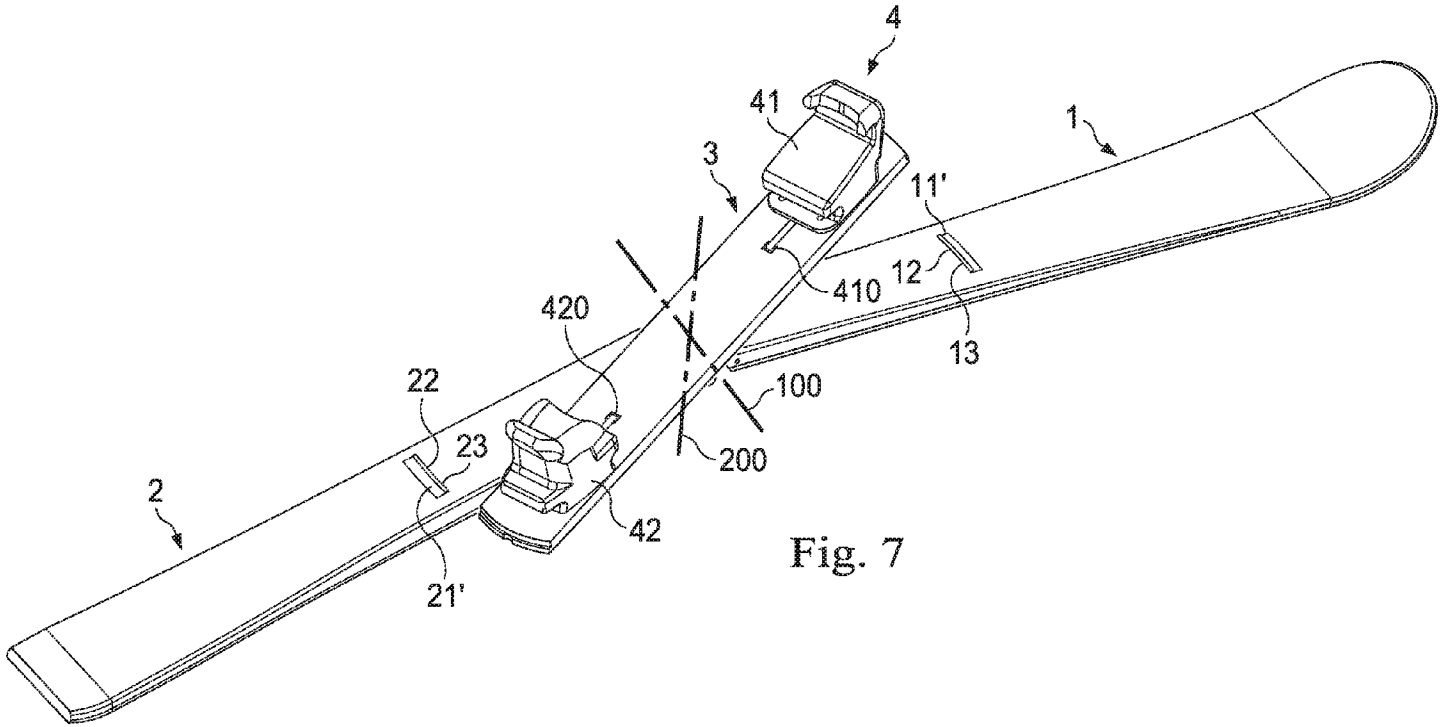
FIG. 7 is an isometric view of a still further embodiment of a ski according during assembling.
Figure 8:
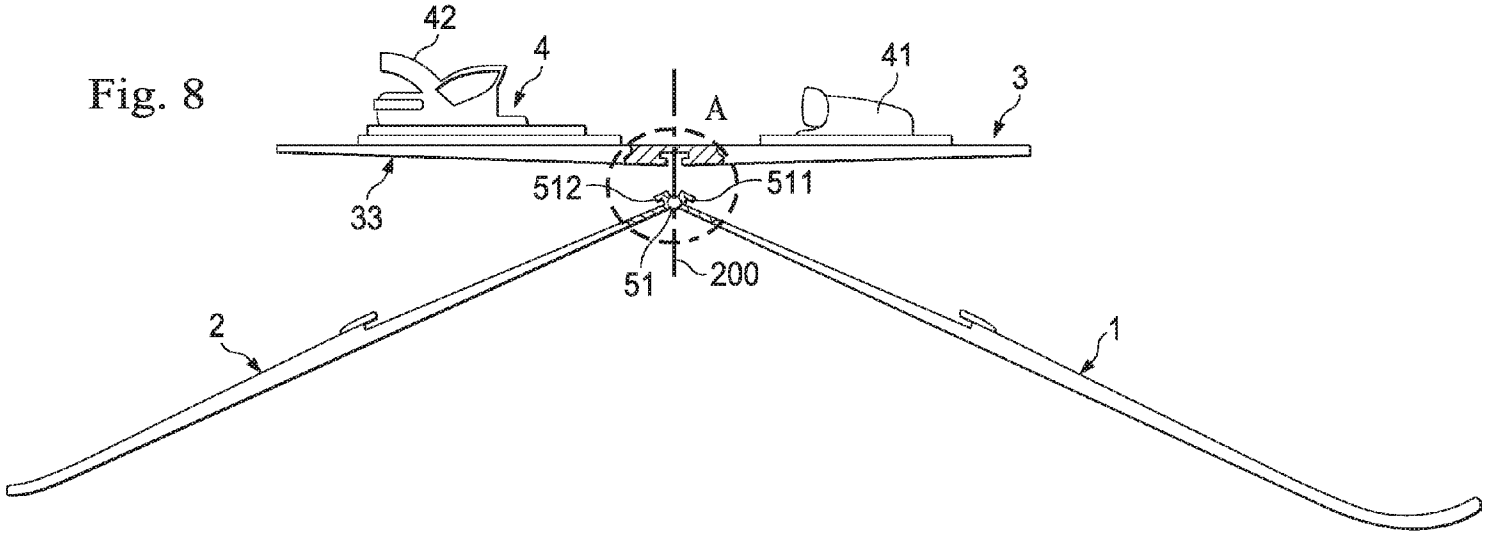
FIG. 8 is a plan view of a still further embodiment of a ski according during assembling.

A further embodiment of the ski is shown in FIGS. 5-7, wherein the front part 1 is provided, on its essentially flat top surface 94 in the area of cooperation with the connecting platform 3, with a guiding protrusion 11', which is ended with a concave circular front surface 12 with a pre-determined radius, in which a groove 13 is available. Similarly, the rear part 2 is also furnished, on its essentially flat top surface 94 in the area of cooperation with the connecting platform 3, with a guiding protrusion 21', which is ended with a concave circular front surface 22 with a pre-determined radius, in which a groove 23 is available.

The connecting platform is also adapted for cooperation or engagement with the parts 1 and 2, in that its width is adjusted to the width of the central region 93 of the ski, and its height is adjusted to the dimensions of the guiding protrusions 11', 21' on the front part 1 and the rear part 2 of the ski. Moreover, connecting platform 3 is, on each terminal portion 30' and 30", furnished with a convex circular surface 31' and 31", each of which is provided with a protrusion 32' and 32". The protrusions 32' and 32" on the surfaces 31' and 31" of the connecting platform 3 are adapted to cooperate with the grooves 13 and 23 on surfaces 12 and 22 of the guiding protrusions 11', 21' on the front part 1 and the rear part 2 of the ski. The curvature radius of the concave surfaces 12, 22 of the guiding protrusions 11' and 21' on parts 1 and 2 is adjusted to the radius of curvature of the convex surfaces 31' and 31" on the connecting platform 3. Thus, the connecting platform 3, when placed above the front part 1 and the rear part 2, is able to rotate around the previously mentioned geometric axis 200.

Those skilled in the art shall understand that after rotation of the platform 3 into position, in which it is aligned with the front part 1 and the rear part 2, and fixation of the platform 3 in such position by means of a suitable arresting or fixation means, such ski is an excellent substitute for a classic ski, by which an average skier should be perfectly satisfied.

Regarding the embodiment according to FIGS. 7-11, the platform 3 is furnished on its bottom surface 33, which is faced towards the front part 1 and the rear part 2 of the ski, with a centrally arranged cavity 35, in which extends coaxially with a vertical axis 200 and in which two diametrically opposite extending recesses 351, 352 are available. Recesses 351 and 352 are adapted to cooperate with two arresting protrusions 511 and 512 on the connecting member 51 (FIG. 9), such that protrusions 511, 512 of the connecting member 51 can be inserted into cavity 35 on the platform 3, when the parts 1 and 2 of the ski are linearly aligned and the platform is rotated at certain angle around the vertical axis 200. By further rotating platform 3 around vertical axis 200 into a position, in which the platform 3 is aligned with parts 1 and 2 of the ski, the arresting or fixing protrusions 511, 512 on the connecting member 51 are located within the recesses 351, 352 on the platform 3 (FIG. 11), so that the platform 3 is firmly, although still in a detachable manner, interconnected with the front part 1 and the rear part 2 of the ski.

As evident in FIGS. 1, 2, and 7, the connecting platform 3 is furnished with assemblies 410, 420 suitable for mounting the front part 41 and the rear part 42 of a ski binding thereon. As also evident in FIGS. 1, 2, and 7, because of the previously described concept of assembling a ski, the present disclosure enables combining a particular connecting platform 3, together with integrated assemblies 410, 420 or without them, with different front parts 1 and rear parts 2 of such a collapsible ski, by which manufacturing of skis, including managing of components and assembling, as well as product or partially-assembled (i.e. semi-) product supply can be optimized in a quite new and non-conventional manner.

The invention claimed is:

1. A collapsible ski, comprising:

in its assembled, functional state:

a front part of the collapsible ski comprising a front portion with a tip slightly bent away from a ground surface;

a rear part of the collapsible ski comprising a rear portion with a tail;

a central region of the collapsible ski comprising a connecting platform, wherein the connecting platform is adapted for mounting a ski binding comprising a front part and a rear part onto a top surface of the collapsible ski, wherein the ski binding is suitable for attaching a ski shoe onto a top surface of the ski, the top surface during use of the collapsible ski being faced away from the ground surface;

an opposite sliding surface, including two ski edges, wherein the opposite sliding surface is faced towards the ground surface during the use of the ski;

wherein the collapsible ski, when assembled, includes the front part of the collapsible ski and the rear part of the collapsible ski mutually interconnected pivotally around a transverse geometrical axis extending parallel to the sliding surface, wherein the front part of the ski is, in an area of engagement with the connecting platform, furnished with a front part indentation, wherein the rear part of the ski is, in the area of engagement with the connecting platform, furnished with a rear part indentation, wherein the connecting platform is adapted to rest within an area of the front part and rear part indentations, and wherein the connecting platform is, on each of its terminal portions, which protrude apart from each other, furnished with a convex circular surface having a pre-determined radius of curvature, wherein each convex circular surface includes a protrusion, wherein the front part indentation terminates with a concave circular surface, wherein a radius of curvature of the front part indentation concave circular surface is adjusted to the radius of curvature on the corresponding terminal portion of the connecting platform, wherein the front part indentation includes a groove, which is adapted to cooperate with the protrusion on the corresponding terminal portion of the connecting platform, and wherein the rear part indentation terminates with a concave circular surface, wherein a radius of curvature of the rear part indentation concave circular surface is adjusted to a radius of curvature on the corresponding terminal portion of the connecting platform, wherein the rear part indentation includes a groove, which is adapted to cooperate with the protrusion on the corresponding terminal portion of the connecting platform.

2. The collapsible ski of claim 1, wherein the tail is one of essentially flat and slightly deflected away from a ground surface.

3. The collapsible ski of claim 1, wherein the connecting platform fixes the front part and rear part of the collapsible ski in a linearly aligned state.

4. The collapsible ski of claim 1, further comprising:

a connecting member for establishing a pivotal interconnection between the front part of the collapsible ski and the rear part of the collapsible ski, wherein the connecting member includes a connecting member front part protrusion and a connecting member rear part protrusion which protrude apart from each other;

wherein the protrusions are arranged such that the connecting member front part protrusion is located at a distance apart from the top surface of the front part of the collapsible ski and is directed towards the tip of the collapsible ski, and the connecting member rear part protrusion is located at a distance apart from the top surface of the rear part of the collapsible ski and is directed towards the tail of the collapsible ski, wherein the connecting platform includes a centrally arranged cavity located on a bottom surface, the cavity facing towards the front part of the collapsible ski and the rear part of the collapsible ski, wherein the cavity includes two diametrically opposite recesses which are adapted to cooperate with the connecting member front part protrusion and the connecting member rear part protrusion, such that the connecting member front part protrusion and the connecting member rear part protrusion on the connecting member are inserted into the cavity when the front part of the collapsible ski and the rear part of the collapsible ski are linearly aligned and the connecting platform is rotated at a certain angle around a vertical axis with respect to its longitudinal direction, and wherein when the connecting platform is rotated around said vertical axis into a position in which it is linearly aligned with the front part of the collapsible ski and the rear part of the collapsible ski, the connecting member front and rear part protrusions are inserted within the recesses in the cavity of the connecting platform, wherein the insertion results in a detachable connection of the front part of the collapsible ski, the rear part of the collapsible ski, and the connecting platform.

5. The collapsible ski of claim 1, wherein the connecting platform further comprises:

a front assembly for mounting the front part of the ski binding; and a rear assembly for mounting the rear part of the ski binding.

6. The collapsible ski of claim 1, wherein the front part of the collapsible ski and the rear part of the collapsible ski are connected with each other in a non-detachable manner.

7. The collapsible ski of claim 1, wherein the front part of the collapsible ski and the rear part of the collapsible ski are connected with each other in a detachable manner.

8. A collapsible ski, comprising:

in its assembled, functional state:

a front part of the collapsible ski comprising a front portion with a tip slightly bent away from a ground surface, a rear part of the collapsible ski comprising a rear portion with a tail;

a central region of the collapsible ski comprising a connecting platform, wherein the connecting platform is adapted for mounting a ski binding comprising a front part and a rear part onto a top surface of the collapsible ski, wherein the ski binding is suitable for attaching a ski shoe onto a top surface of the ski, the top surface during use of the collapsible ski being faced away from the ground surface;

an opposite sliding surface, including two ski edges, wherein the opposite sliding surface is faced towards the ground surface during use of the collapsible ski;

wherein the collapsible ski, when assembled, includes the front part of the collapsible ski and the rear part of the collapsible ski mutually interconnected pivotally around a transverse geometrical axis extending parallel to the sliding surface, wherein the front part of the collapsible ski is, in an area of engagement with the connecting platform, furnished with a front part guiding protrusion located on an essentially flat top surface of the collapsible ski;

wherein the rear part of the collapsible ski is, in the area of engagement with the connecting platform, furnished with a rear part guiding protrusion located on the essentially flat top surface of the collapsible ski, wherein the connecting platform is adapted to rest within an area of the front part and rear part guiding protrusions;

wherein the connecting platform is, on each of its front and rear terminal portions which protrude apart from each other, furnished with a convex circular surface having a pre-determined radius of curvature, wherein each of the front and rear convex circular surfaces include a protrusion, wherein the front part guiding protrusion includes a concave circular surface, wherein a radius of curvature of the front part guiding protrusion is adjusted to the radius of curvature on the front convex circular surface of the connecting platform, wherein the front part guiding protrusion further includes a groove adapted to engage with the front convex circular surface protrusion, and wherein the rear part guiding protrusion includes a concave circular surface, wherein a radius of curvature of the rear part guiding protrusion is adjusted to a radius of curvature on the rear convex circular surface of the connecting platform, wherein the rear part guiding protrusion further includes a groove adapted to engage with the rear convex circular surface protrusion.

9. The collapsible ski of claim 8, wherein the tail is one of essentially flat and slightly deflected away from a ground surface.

10. The collapsible ski of claim 8, wherein the connecting platform fixes the front part and rear part of the collapsible ski in a linearly aligned state.

11. The collapsible ski of claim 8, further comprising:

a connecting member for establishing a pivotal interconnection between the front part of the collapsible ski and the rear part of the collapsible ski, wherein the connecting member includes a connecting member front part protrusion and a connecting member rear part protrusion which protrude apart from each other;

wherein the protrusions are arranged such that the connecting member front part protrusion is located at a distance apart from the top surface of the front part of the collapsible ski and is directed towards the tip of the collapsible ski, and the connecting member rear part protrusion is located at a distance apart from the top surface of the rear part of the collapsible ski and is directed towards the tail of the collapsible ski, wherein the connecting platform includes a centrally arranged cavity located on a bottom surface, the cavity facing towards the front part of the collapsible ski and the rear part of the collapsible ski, wherein the cavity includes two diametrically opposite recesses which are adapted to cooperate with the connecting member front part protrusion and the connecting member rear part protrusion, such that the connecting member front part protrusion and the connecting member rear part protrusion on the connecting member are inserted into the cavity when the front part of the collapsible ski and the rear part of the collapsible ski are linearly aligned and the connecting platform is rotated at a certain angle around a vertical axis with respect to its longitudinal direction, and wherein when the connecting platform is rotated around said vertical axis into a position in which it is linearly aligned with the front part of the collapsible ski and the rear part of the collapsible ski, the connecting member front and rear part protrusions are inserted within the recesses in the cavity of the connecting platform, wherein the insertion results in a detachable connection of the front part of the collapsible ski, the rear part of the collapsible ski, and the connecting platform.

12. The collapsible ski of claim 8, wherein the connecting platform further comprises:

a front assembly for mounting the front part of the ski binding; and a rear assembly for mounting the rear part of the ski binding.

13. The collapsible ski of claim 8, wherein the front part of the collapsible ski and the rear part of the collapsible ski are connected with each other in a non-detachable manner.

14. The collapsible ski of claim 8, wherein the front part of the collapsible ski and the rear part of the collapsible ski are connected with each other in a detachable manner.

* * * * *